US005403362A

United States Patent [19]

Gurley

[11] Patent Number: 5,403,362

[45] Date of Patent: Apr. 4, 1995

[54] MORDANT AND METHOD OF DYEING FIBERS

[75] Inventor: Sally Gurley, Boulder, Colo.

[73] Assignee: Allegro Natural Dyes Inc., Longmont, Colo.

[21] Appl. No.: 59,544

[22] Filed: May 10, 1993

[51] Int. Cl.[6] ..... D06P 1/34; D06P 1/36; C09B 65/00

[52] U.S. Cl. ..... 8/618; 8/625; 8/646; 8/653; 8/918; 8/921

[58] Field of Search ..... 8/618, 625, 653, 646, 8/425, 452, 453, 625, 653, 646, 918, 921

[56] References Cited

U.S. PATENT DOCUMENTS

| | | | |
|---|---|---|---|
| 192,201 | 6/1877 | Van Skelline . | |
| 671,760 | 4/1901 | Florin . | |
| 1,273,293 | 7/1918 | Warkup . | |
| 1,565,515 | 12/1925 | Seyer . | |
| 1,757,066 | 5/1930 | Watson . | |
| 2,152,182 | 3/1939 | Ellis . | |
| 2,991,143 | 7/1961 | Rosenlind . | |
| 4,283,198 | 8/1981 | Fletcher | 8/653 |
| 4,486,237 | 12/1984 | Paffoni et al. | 106/308 Q |
| 4,756,037 | 7/1988 | McFadyen et al. | 8/150 |
| 4,845,789 | 7/1989 | Morton et al. | 8/150 |
| 4,882,140 | 11/1989 | Becker | 423/629 |

OTHER PUBLICATIONS

Crews, P., Part 1. Considerations in the Selection and Application of Natural Dyes: Mordant Selection,: Shuttle, Spindle & Dyepot 12:15,62 (Spring, 1981).

J. Greene, "Plant Dyes for Homespun Color," Horticulture Aug. 1978).

R. Smith and S. Wagner, "Dyes and the Environment: Is Natural Better?" Amer.. Dyestuff Rep. 80(9):32 (Sep. 1991).

P. M. Suave, "Natural Dyes in Quebec," *Color Res. & Appl.* 6:172–173 (Fall 1981).

R. N. Padhye and D. Rathi, "Effect on Mordant Dyeing of Cotton with Vegetable Dyes," *Textile Dyer & Printer* 23(25):27–28 (Dec. 12, 1990).

A. Sayeed, et al., "Jute Fiber Dyeing with Catechu Tannic Acid and Catechin," *Indian Textile J.* 100(9):114–119 (Jun., 1990).

D. Bahl, et al., "Development of Dyeing Process of Silk with Natural Dye-Cutch," *Colourage* 35(22):22–24 (Nov. 16, 1988).

V. A. A. Shenai, et al., "Studies on Natural Dyes, Part II, Dyeing and Printing of Cotton Cloth with Ain Bark Extract by Suitable After-Treatments," *Textile Dyer & Printer* 12:29–31 (Jun., 1979).

A. Garg, et al., "Effect of Mordants on Color of Natural Dye Extracted from Tessue Flowers (*Butea mongsperma*)," *Colourage* 38(3):50–53 (Mar., 1991).

S. J. Rama and K. C. Gupta, "Parijataka-a good source of dye for woollens," *Textile Dyer & Printer* 23(25):27–28 (Dec. 12, 1990).

S. Vednere, et al., "Teak leaves and chir bark as natural (List continued on next page.)

*Primary Examiner*—Paul Lieberman
*Assistant Examiner*—Margaret Einsmann
*Attorney, Agent, or Firm*—Howard & Howard

[57] ABSTRACT

An improved mordant solution and process for preparing fibers for dyeing and fixing natural dyes to fibers, particularly but not exclusively cellulose fibers, including cotton and linen, and synthetic fibers, including Rayon ® and Tensel TM. The improved natural mordant solution comprises an aqueous solution of alum $KAl(SO_4)$ and soda ash $Na_2CO_3$, most preferably an aqueous colloidal suspension of aluminum hydroxide. This mordant solution significantly improves the recognized measurable qualities of naturally dyed fibers, including light and washfastness, without using polluting heavy metal mordants. The improved mordant treatment and natural dye process includes first pretreating the fabric with an aqueous mordant wash, which increases the dye uptake in the dye bath, then treating the fabric with a second aqueous mordant wash, following dyeing, then preferably treating the dyed fabric with a final tannin wash, permanently setting the natural dye in the fibers or fabric.

10 Claims, No Drawings

OTHER PUBLICATIONS dyes for wool," *Colourage* 37(20):48–49 (Dec., 1990).

Simmons, Max, "The Mordant Process," *Dyes and Dyeing,* (no month available 1978) Van Nostrand Reinhold, Australia.

Liles, J., *The Art and Craft of Natural Dyeing*, pp. 3–5, Appendix B, University of Tennessee Press (no month available 1990).

Bliss, Anne, *A Handbook of Dyes from Natural Materials,* Chapter 2, pp. 21–25, 37–39; Charles Scribner's Sons (no month available 1981).

Brunello, Franco, *The Art of Dyeing in the History of Mandkind*, p. 308, Neri Pozza Editore (no month available 1973).

MORDANT AND METHOD OF DYEING FIBERS

BACKGROUND OF THE INVENTION

This invention relates to an improved mordant solution which is particularly suitable for dyeing cellulose fibers, such as cotton and linen, without the use of dangerous and polluting heavy metal salt or iron mordants. The method of this invention further includes a process for dyeing such fibers using natural dyes and nonpolluting mordants.

The use of synthetic dyes began with Perkin's accidental synthesis of mauvein ($C_{27}H_{24}N_4$) or "aniline purple" in 1856. Perkin was attempting to synthesize quinine, but recognized the commercial potential of mauvein as a synthetic dye. The synthetic dye industry was the major synthetic organic chemical industry in the early 1900's. Synthetic dyes have now virtually replaced natural or vegetable dyes the textile industry, relegating natural dyes to use by hobbyists and cottage industries. The annual global sales of synthetic dyes are now estimated to be about $20,000,000,000.

Production and use of synthetic dyes however produces serious toxic waste problems. The dye industry has recently attempted to reduce toxic effluents by recharging dyebaths, using different dye techniques that are more efficient, recycling and recovering waste, and using computer technology to control the introduction of dyes and chemicals in the bath. Exhaustion rates have been improved in certain facilities to above about 65%; however, the average exhaustion rate remains about 40% and the synthetic dye industry continues to be a major source of pollution, discharging heavy metal salts and other toxic waste into the environment.

Because of the problems associated with synthetic dyes, there has been a renewed interest in natural or vegetable dyes. Natural dyes, such as indigo, tannin and madder have been used since the beginning of recorded history; however, it is almost impossible using known techniques to obtain the same dye shade twice in succession with natural dyes, even using the same method. As noted by a major synthetic dye manufacturer, the color-giving molecules in the plants used for dyeing have not been "specifically designed by nature" for transfer to a substrate. Using prior natural dyeing processes, it is often necessary to choose conditions which severely damage the fiber to obtain a suitably dyed fabric. Further, it has not been possible to obtain dyed fabrics which are light and washfast and it has not been possible to obtain a full palette of colors, using natural dyes. Thus, the textile industry has generally rejected natural dyes for commercial applications.

The most commonly used mordants for natural dyes are also potential sources of toxic waste. Mordants are chemicals that are necessary to chemically fix most natural dyestuffs. The mordant combines with both the dye molecule and the fiber molecule, producing a permanently fixed insoluble "color lake." The insoluble mordant-dye complex that is chemically combined with the fiber in a mordant dyed fiber is referred to as a color lake. Color lakes are produced with adjective dyes. Color lakes produced by reacting a dye with a metallic salt, such as madder (alizarin) with alum, were also used in inks and paints. The most commonly used mordants for natural dyes are alum or potassium aluminum sulfate, chrome or potassium dichromate or potassium bichromate, blue vitriol or copper sulfate, ferrous sulfate, stannous chloride, sodium dithionite or sodium hydrosulfite, ammonia hydroxide, cream of tartar or potassium bitartrate, "Glauber's salt" or sodium sulfate, lime, lye or sodium hydroxide, oxalic acid, tannic acid, uria, vinegar or acetic acid and washing soda or sodium carbonate. As will be understood, several of these mordants produce toxic waste, but the prior art has failed to produce permanently dyed cellulose fibers or fabric which are color and washfast and which produce a wide range or palette of colors, even using heavy metal salt mordants.

Thus, there is an urgent need for a natural dye process which can meet the needs of the commercial textile industry, including a full palette of consistently reproducible natural colors, which are wash and lightfast. Further, there is an urgent need for a mordant and dye process which does not produce toxic wastes. The mordant and dye process of this invention meets both of these urgent needs.

SUMMARY OF THE INVENTION

The improved mordant of this invention may be used for pretreatment of fibers, including cellulose fibers, for dyeing and for setting of natural dyes in such fibers, including, for example, cotton and linen fabrics and synthetic textiles which are often difficult to dye, including Rayon® and Tensel™ fibers and textiles. The improved nonpolluting mordant of this invention comprises all aqueous solution of alum or potassium aluminum sulfate ($KA1(SO_4)_2.12H_2O$) and soda ash ($Na_2CO_3$). The most preferred mordant solution of this invention comprises a colloidal suspension of aluminum hydroxide in aqueous solution, wherein the concentration of alum is about seven times the concentration of soda ash, in weight percent. The preferred mordant colloidal suspension may be formed by adding alum to an aqueous solution of soda ash in water, agitating and heating the solution to about 150° F. In a typical application using a dye liquor containing the vegetable dye Osage, the second mordant solution may contain 0.45% by weight soda ash and 3% by weight alum. In another example where the dye liquor includes the vegetable dyes Madder or Cutch, the second mordant solution contains 0.3% by weight soda ash and 2% by weight alum.

The preferred method or process of this invention for permanently dyeing fibers, including natural cellulose fibers, includes pretreating the fibers with a mordant solution comprising an aqueous solution of alum and soda ash. The pretreated or premordanted fibers are then treated, following washing, with a dye liquor preferably containing a natural dye. The fibers are then treated with a second nordant solution, which is also preferably an aqueous solution of alum and soda ash, as described. The second mordant solution is preferably added directly to the dye bath, near the end of the dye treatment cycle. Finally, the fibers are preferably treated with a weak solution of tannic acid, further setting the natural dye in the fibers.

More specifically, the disclosed natural dye process includes first pretreating the fibers by wetting the fibers with a commercially available wetting agent, then immersing and agitating the fibers in the presence of the aqueous mordant solution, preferably at a temperature of about 110° to 170° F. for about an hour. In the most preferred method of pretreatment, the fibers are treated with the mordant in temperature stages, first at a lower temperature of for example 120° F. for about twenty minutes, then at a higher temperature of for example 140° F. for about ten minutes and finally at about 165° F. for about 45 minutes. This results in improved dye uptake and cleaner effluent. The liquid is then drained and the fibers are rinsed with warm water and preferably dried. The pretreated or premordanted fibers are then treated with a dye, preferably an aqueous natural dye liquor, for sufficient time to produce the desired color. The fibers are then treated with a second mordant solution, preferably an aqueous solution of alum and soda ash, as described. The second mordant solution may be added directly to the dye liquor, preferably near the end of the dye treatment cycle; for example, in the last fifteen minutes. The dye liquor is then drained. In the most preferred method of dyeing natural cellulose fibers, the fibers are finally treated with a weak aqueous solution of tannin or tannic acid containing about 1% tannic at a temperature of about 140° F., which further sets the natural dye in the fibers. The fibers are then rinsed, drained and dried.

The improved mordant solution and natural dye process of this invention produces permanently dyed fibers and fabrics or textiles which are light and washfast and can be used to produce a full palette of reproducible natural colors. Further, the mordant and dye process of this invention does not require the use of heavy metal salts or iron and thus produces permanently dyed fibers in a wide range of colors without producing toxic waste. Finally, the mordant natural dye process of this invention requires significantly less energy than commercial dye processes. The mordant solution and natural dye process of this invention thus solves the problems with the prior natural dye processes and avoids the pollution and toxic waste problems associated with synthetic dyes. Other advantages and meritorious features of this invention will be more fully described in the following description of the preferred embodiments of the mordant solution and natural dye process of this invention which follows and the appended claims.

DETAILED DESCRIPTION OF PREFERRED EMBODIMENTS OF IMPROVED MORDANT AND NATURAL DYE MORDANT PROCESS OF THIS INVENTION

As described, the improved nonpolluting mordant solution of this invention is particularly, but not exclusively suitable for dyeing natural cellulose fibers, including cotton and linen. Natural dye mordant processes were used long before the introduction of synthetic dyes in the late mid 19th century. The mordant and natural dye mordant process of this invention may be used with many natural or vegetable dyes, some of which had been used since before recorded history. Natural dyes which may be used in the dye process of this invention include, but are not limited to madder, cochineal, cutch and osage. Madder is a vegetable dye produced from species of Rubis, herbaceous perennials grown in Europe and Asia. Preparations of dyes from madder root were used to produce red, yellow and brown colorations prior to the introduction of synthetic dyes. The mordants used with madder dyes included chromium, aluminum, iron, copper, tin and other heavy metal and polluting salts. Cochineal is an insect dyestuff indigenous to Mexico, which was in use by natives when the Spaniards invaded Mexico in 1518. The insect cochineal is the *Coccus cacti* which is cultivated in Mexico, Peru and other countries for producing carmine red. Stannous chloride was the principal mordant used with cochineal. Cutch or Catechu, also known as *Terra japonica,* is obtained from various species of Mimosa, Acacia and Areca trees chiefly found in India, Southern Asia and Africa. The commercial dye product is an extract obtained by boiling the wood, trees, leaves and fruit and processed to produce a yellow or olive color, depending upon the mordant used. The mordant solution of this invention may also be used with indigo; however, the indigo dye process is described in a separate patent application filed concurrently herewith. The methods of processing and preparing dye liquors from madder, cochineal, cutch, indigo and other natural dye substances are well documented in the literature and such processes are not, therefore, described herein.

As described above, the improved mordant of this invention may be used both for pretreating or premordanting the fibers, prior to dyeing and for mordanting, following dyeing. The preferred mordant solution is an aqueous solution of alum and soda ash. More specifically, the preferred mordant solution of this invention comprises a colloidal suspension of aluminum hydroxide in aqueous solution, wherein the concentration of alum is about seven times the concentration of soda ash, in weight percent. This colloidal suspension may be formed by first adding fiber soda ash to water to form an aqueous solution of soda ash. Fiber alum or potassium aluminum sulfate is then slowly added to the aqueous solution of soda ash while the solution is agitated and heated to about 150° F. The colloidal suspension begins to form at about 140° F.

The fibers to be dyed, which may be in the form of a garment, pieces of textile or yarn, is then pretreated with the mordant solution, as follows. First, the fibers are wetted out by agitating the fibers with a commercial wetting solution, such as "Ecowet" available from Southeast Chemical Corp. The fibers are then agitated in the mordant solution and heated to about 165° F. In the most preferred premordant process, the fibers are immersed in the mordant solution which is first heated to about 120° F. and agitated for about ten minutes. The mordant solution is then heated to about 140° F. and agitated for an additional ten minutes. Finally, the mordant solution is heated to about 165° F. and agitated for about forty-five minutes. The mordant solution is then drained, the fibers are rinsed in warm water and dried. The fibers are now ready for dyeing.

After wetting the fibers, the fibers are immersed and agitated in an aqueous solution of the natural dye liquor for a time sufficient for uptake of the dye. A second mordant solution is then introduced, preferably near the end of the dye cycle and the fibers are agitated in the mordant and dye solutions for about fifteen minutes. Finally, the fibers are preferably agitated in a weak aqueous solution of tannic acid or tannin.

The mordant solution and natural dye mordant process of this invention will be more fully understood from the following examples. 9,100 gms or about twenty pounds of cotton garments were pretreated or premordanted with the nonpolluting mordant solution of this invention, as follows. Two percent of the weight of the fibers or 182 gms of soda ash was added to five gallons of warm water and stirred to dissolve all of the soda ash in solution. Fifteen percent of the weight of the fibers or 1,365 gms of alum was then added slowly to the aqueous solution of soda ash to avoid flashing. The solution was then heated to about 150° F. and stirred to form a colloidal suspension of aluminum hydroxide in water.

The fibers are then pretreated by first wetting out the fibers with warm water and 40 ml of "Ecowet" commercial wetting solution. The fibers are then heated to 120° F. and one-half of the premordant solution was added and the fibers were agitated for ten minutes. The fibers and mordant solution was then heated to 140° F., the remainder of the mordant solution was added and the fibers were agitated in the mordant solution for an additional ten minutes. The aqueous mordant solution was then heated to 165° F. and agitated for an additional forty-five minutes. The fibers and solution were then cooled to 120° F., drained, rinsed and dried.

The natural dye mordant process of this invention may be carried out in a conventional commercial or industrial washing machine. A computer control industrial washing machine may be preferred which allows the operator to preprogram the introduction of fluids, such as water into the washing machine chamber or basket, temperature and time, including wash and agitation cycles, etc. Further, it is possible to program an industrial washer to ramp up or down the temperature while agitating the fibers, as described herein. A suitable industrial washing machine for the natural dye mordant process of this invention is the Unimac Washer Extractor made by Unimac Corporation; however, the process of this invention is not limited to any particular machine or equipment. In fact, tile natural dye mordant process of this invention may be adapted to existing dye apparatus and processes, including package dye machines.

Cotton fibers in the form of garments were dyed with cochineal, as follows. Twenty pounds (9,100 gms) of pretreated cotton fibers in the form of garments were first wetted out with warm water containing 40 ml of "Ecowet" commercial wetting solution. One gallon (2.79 liters) of water containing cochineal dye extract was added to the wetted out fibers and heated at two degrees per minute to 165° F. The fibers were then agitated in the aqueous dye solution for thirty-five minutes. A second aqueous mordant solution containing 0.3% soda ash (27.3 gms) and 2% weight of fibers (182 gms) was added and the fibers were agitated for fifteen minutes. The second mordant solution was prepared as described above to produce a colloidal suspension of aluminum hydroxide.

The dye mordant solution was then drained and an aqueous solution containing 1% weight of fiber (91 gms) tannin was added to the chamber. The chamber was then heated to 140of and agitated for ten minutes. The tannin solution was then drained, the fibers were washed with detergent, rinsed and dried.

The same procedure was used to dye pretreated fibers with osage, except that 15% weight of fibers osage dye extract or 2.33 gallons was added to the pretreated fibers after wetting and the second mordant solution contained 0.45% weight of fibers (41 gms) soda ash and 3% weight of fibers (273 gms) of alum was prepared as described to produce an aqueous colloidal suspension of aluminum hydroxide.

Although the manufacture and use of synthetic dyes remains a major source of pollution, the commercial textile industry has rejected natural or vegetable dyes because such dyes are not reproducible and the dyed fabrics are not light and washfast using present methods. Protein fibers, such as wool, are somewhat easier to dye and natural dyes are used to a limited extent to dye protein fibers. Further, as set forth above, indigo remains in use for dyeing denim yarn. However, cotton is the primary natural fiber used by the garment industry, accounting for nearly fifty percent of the fibers used. There is, however, no natural dye mordant process for dyeing cotton fibers, fabric or garments which results in a wash and lightfast garment.

The mordant dye process of this invention does produce consistent dyed yarns, textile pieces and garments in a wide range of natural colors. Further, the colors are wash and lightfast. The American Association of Textile Colorists and Chemists have developed standardized tests to determine whether a dyed fabric is washfast (Test No. 61A) and lightfast (Test No. 16E). The potential score or index on such tests range from 0 to 5. Fabrics dyed with natural dyes using conventional natural dye mordant processes score only 1 or 2 on the light and washfast tests for cotton fabrics; however, synthetic dyes generally score about 4 or even greater on such tests. The natural dye mordant process of this invention, however, results in a dyed fabric which scores between 3 and 5 on such tests, equal to or greater than synthetic dyes on the same fabrics. Further, as set forth above, the natural dye mordant process of this invention does not result in pollution.

As will be understood by those skilled in the art, certain modifications can be made to the nonpolluting mordant and natural dye mordant process of this invention within the purview of the appended claims. The natural dye mordant process of this invention is not limited to the natural dyes disclosed herein, but may be used for other dyes. Further, the natural dye mordant process is not limited to dyeing cotton or other cellulose fibers, although the process of this invention is very successful with cellulose fibers, which are difficult to dye, particularly with natural dyes. The process of this invention may also be used with some synthetic yarns and fabrics. Finally, the improvements in the nonpolluting mordant solution and natural dye mordant process of this invention may be used individually or in combination to produce improved dyed fibers or fabric. For example, the use of a final tannin treatment following the dye-mordant step resulted in a 10 to 20% improvement in wash and lightfastness. The use of an aqueous colloidal suspension of aluminum hydroxide resulted in a 20 to 40% improvement in such tests and the use of a second mordant treatment resulted in a further 10% improvement. As will be understood, these improvements were unexpected, particularly in view of the long history of the use of natural dyes and the replacement of natural dyes by synthetic dyes over a century ago.

I claim:

1. A process for permanently dyeing fibers, fabrics and textiles selected from the group consisting of cotton, linen and other cellulose fibers, said process comprising the following steps:

pretreating said fibers at a temperature between about 110° F. and about 170° F. with a mordant comprising an aqueous colloidal suspension formed by adding soda ash and alum to warm water wherein the concentration of alum is about seven times the concentration of soda ash in weight percent and wherein the mordant is present in an amount sufficient to fix a natural dye; and treating said fibers with an aqueous solution containing a natural dye liquor wherein the natural dye is present in an amount sufficient to permanently dye said fibers.

2. The process for permanently dyeing fibers as defined in claim 1, wherein said process further includes treating said fibers with said mordant following dyeing.

3. The process for permanently dyeing fibers as defined in claim 2, wherein said process further includes treating said fibers with an aqueous solution of tannic acid following treating said fibers with said mordant following dyeing.

4. The process for permanently dyeing fibers as defined in claim 1, wherein said mordant is formed by adding alum to an aqueous solution of soda ash, agitating and heating said solution to a temperature of at least about 150° F.

5. The process for permanently dyeing fibers as defined in claim 1, wherein said mordant is formed by first adding soda ash to water, forming an aqueous solution of soda ash in water, then adding alum to said solution, agitating and heating said solution to form said colloidal suspension.

6. A process for permanently dyeing fibers, fabrics and textiles selected from the group consisting of cotton, linen, and other cellulose fibers, comprising the following steps:

pretreating said fibers by immersing said fibers in water containing a mordant which comprises an aqueous colloidal suspension formed by first adding soda ash to said water, then adding alum to form a colloid suspension, wherein the concentration of alum is about seven times the concentration of soda ash, in weight percent, and wherein the mordant is present in an amount sufficient to fix a natural dye, and agitating said fibers at a temperature of at least about 110° F. to about 170° F.;

treating said fibers with an aqueous solution containing a natural dye liquor in an amount sufficient to permanently dye said fibers; and treating said fibers with said mordant solution to further bond said dye to said fibers.

7. The process of permanently dyeing fibers as defined in claim 6, wherein said mordant is formed by adding alum to an aqueous solution of soda ash at a temperature of about 120° to 170° F.

8. The process of permanently dyeing fibers as defined in claim 6, wherein said process further includes treating said fibers with an aqueous solution of tannic acid following said treatment of said fibers with said second mordant solution.

9. The process of permanently dyeing fibers as defined in claim 8, wherein said second mordant solution is added to said fibers near completion of dye treatment.

10. The process of permanently dyeing fibers as defined in claim 6, wherein said mordant is formed by adding alum to an aqueous solution of soda ash and water, agitating and heating said mixture to form said colloidal suspension.

* * * * *